United States Patent [19]

Mehlman

[11] Patent Number: 4,488,903

[45] Date of Patent: Dec. 18, 1984

[54] RAPID DECARBURIZATION STEELMAKING PROCESS

[75] Inventor: Stewart K. Mehlman, Tarrytown, N.Y.

[73] Assignee: Union Carbide Corporation, Danbury, Conn.

[21] Appl. No.: 589,469

[22] Filed: Mar. 14, 1984

[51] Int. Cl.[3] ..... C21C 5/34

[52] U.S. Cl. ..... 75/52; 75/60

[58] Field of Search ..... 75/51–60

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |
| 4,210,442 | 7/1980 | Lewis et al. | 75/60 |
| 4,278,464 | 7/1981 | Bury et al. | 75/51 |
| 4,280,838 | 7/1981 | Marukawa | 75/60 |
| 4,308,057 | 12/1981 | Ono | 75/60 |
| 4,348,227 | 9/1982 | Brotzmann | 75/60 |
| 4,356,035 | 10/1982 | Brotzmann et al. | 75/52 |
| 4,365,992 | 12/1982 | Sieckman | 75/60 |
| 4,369,060 | 1/1983 | Metz | 75/60 |

*Primary Examiner*—Peter D. Rosenberg

*Attorney, Agent, or Firm*—Stanley Ktorides

[57] ABSTRACT

A decarburization procedure for rapidly decarburizing a steel melt comprising top injection of oxygen and powdered lime and bottom injection of oxygen and inert gas, discontinuance of the top injection at a specified time, and decarburization to the aim carbon content by the bottom injection.

27 Claims, No Drawings

RAPID DECARBURIZATION STEELMAKING PROCESS

TECHNICAL FIELD

This invention relates to the pneumatic refining of steel and more particularly to the decarburization of a steel melt.

BACKGROUND ART

Recent advances in ironmaking are making hot metal relatively more attractive for use in mini-mills. However for a mini-mill effectively to use such hot metal, in lieu of part or all of the scrap metal heretofore employed, it must decarburize the hot metal. Furthermore such decarburization must be rapidly carried out. This is particularly the case where sequence casting is carried out. A major process step in steel refining is decarburization, hence the need for rapid decarburization.

However, rapid decarburization, as practised in a basic oxygen furnace, for example, has been associated with a number of disadvantages. One such disadvantage is the increased risk of slopping caused by the increased vigor of the decarburization reaction. Another disadvantage is a loss of carbon end point accuracy. A third disadvantage is inefficiency caused by localized imbalances of oxygen to carbon causing some oxygen to react with iron and thus reducing yield.

Furthermore, the recent advances in ironmaking tend to produce high-sulfur hot metal. Consequently, the material must be desulfurized as well as decarburized. Moreover, even in a conventional integrated steel mill, there is increased pressure to produce low-sulfur steel. It is desirable to provide a process which can rapidly decarburize a steel melt and also desulfurize the steel melt.

Still further, it is desirable to carry out, in addition to decarburization and desulfurization, other refining steps such as deoxidation and degassing, in an efficient manner compatible with rapid decarburization.

One well known steelmaking process which can achieve high quality in these other steps is the argon-oxygen decarburization (AOD) process. Thus it is desirable to provide a rapid decarburization process which can be used in conjunction with the AOD process.

It is therefore an object of this invention to provide a process for the rapid decarburization of a steel melt.

It is another object of this invention to provide a process for the rapid decarburization of a steel melt while avoiding to a large extent an increased risk of slopping.

It is still another object of this invention to provide a process for the rapid decarburization of a steel melt with excellent carbon end point accuracy.

It is a further object of this invention to provide a process for the rapid decarburization of a steel melt wherein sufficient heat is generated to enable melting of scrap and minimization of fuel element consumption.

It is a still further object of this invention to provide a process for the rapid decarburization of a steel melt while additionally attaining good desulfurization of the steel melt.

It is yet another object of this invention to provide a process for the rapid decarburization of a steel melt while additionally attaining good deoxidation and degassing of the steel melt.

It is still a further object of this invention to provide a process for the rapid decarburization of a steel melt which is compatible with the AOD process.

SUMMARY OF THE INVENTION

The above and other objects which will become apparent to one skilled in the art upon a reading of this disclosure are attained by the process of this invention, one aspect of which is:

A process for the production of steel wherein a steel melt undergoes rapid decarburization to an aim carbon content comprising:

(A) providing a molten metal bath having a carbon content of at least 1.0 weight percent;

(B) injecting oxygen and powdered lime into said bath from above the surface thereof while simultaneously injecting oxygen and inert gas into the melt from below the melt surface, the amount of top injected oxygen being from 0.5 to 3 times the amount of bottom injected oxygen, to decarburize the melt until the melt has a carbon content of at least 0.1 weight percent, but not more than 0.5 weight percent, greater than the aim carbon content;

(C) thereafter discontinuing the top injection of oxygen and powdered lime; and (D) injecting oxygen and inert gas into the melt from below the melt surface to decarburize the melt until the aim carbon content is attained.

Another aspect of the process of this invention is:

a process for the production of steel wherein a steel melt undergoes rapid decarburization to an aim carbon content and attains good desulfurization, deoxidation and degassing comprising:

(a) providing a molten metal bath having a carbon content of at least 1.0 weight percent;

(b) injecting oxygen and powdered lime into said bath from above the surface thereof while simultaneously injecting oxygen and inert gas into the melt from below the melt surface, the amount of top injected oxygen being from 0.5 to 3 times the amount of bottom injected oxygen, to decarburize the melt until the melt has a carbon content of at least 0.1 weight percent, but not more than 0.5 weight percent, greater than the aim carbon content;

(c) thereafter discontinuing the top injection of oxygen and powdered lime;

(d) injecting oxygen and inert gas into the melt from below the melt surface to decarburize the melt until the aim carbon content is attained;

(e) adding at least one reducing agent to the bath; and (f) injecting inert gas into the melt from below the melt surface in an amount and at a rate to mix the melt and the slag, thereby transferring sulfur from the melt to the slag, while generating sufficient off-gas to substantially prevent ambient air from contacting the melt.

As used herein, the term "off-gas" means the gases which come off a steel melt during decarburization, reduction or finishing of the melt.

As used herein, the term "reducing agent" means a material which reacts with metallic oxides formed during decarburization.

As used herein, the term "reduction step" means the recovery of metals oxidized during decarburization by the addition to the melt of a reducing agent such as silicon, or a silicon containing ferroalloy, or aluminum followed by sparging the melt to complete the reduction reaction.

As used herein, the term "finishing step" means final adjustments to the melt chemistry by addition to the melt of required material followed by sparging the melt to assure uniform composition.

As used herein, the term "deoxidation" means the removal of dissolved oxygen from the melt by reaction with a reducing agent or other element such as calcium or rare earth metal wherein the product of the deoxidation reaction is an oxide which is incorporated into the slag or remains in the melt as a non-metallic inclusion.

As used herein, the term "degassing" means the removal of dissolved gases from the melt by sparging with inert gas, or inert gas and carbon monoxide generated during decarburization.

As used herein, the term "fluxing" means substantially dissolving the solid slag-forming aditions, for example lime, into a liquid slag.

As used herein, the term "hot metal" means liquid pig iron containing at least 1.0 weight percent carbon.

As used herein, the term "lime" means a solid, containing principally calcium oxide. It is expressly understood that a solid containing a mixture of principally calcium oxide and magnesium oxide could be utilized for a portion or even all of the lime but in somewhat different quantities.

As used herein, the term "decarburization" means oxidation of carbon dissolved in the steel melt to form carbon monoxide.

As used herein, the term "bath" means the contents inside a steelmaking vessel during refining, and comprising a melt, which comprises molten steel and material dissolved in the molten steel, and a slag, which comprises material not dissolved in the molten steel.

As used herein, the term "top injected" means injected into a bath from above the melt surface.

As used herein, the term "bottom injected" means injected into a bath from below the melt surface and is not limited to injection through the vessel bottom. For example, injection could take place through the vessel side.

As used herein, the terms "argon oxygen decarburization process" or "AOD process" mean a process for refining molten metals and alloys contained in a refining vessel provided with at least one submerged tuyere comprising:

(a) injecting into the melt through said tuyere(s) an oxygen-containing gas containing up to 90 percent of a dilution gas, wherein said dilution gas may function to reduce the partial pressure of the carbon monoxide in the gas bubbles formed during decarburization of the melt, alter the feed rate of oxygen to the melt without substantially altering the total injected gas flow rate, and/or serve as a protective fluid, and thereafter (b) injecting a sparging gas into the melt through said tuyere(s) said sparging gas functioning to remove impurities from the melt by degassing, deoxidation, volatilization or by flotation of said impurities with subsequent entrapment or reaction with the slag. Useful dilution gases include argon, helium, hydrogen, nitrogen, steam or a hydrocarbon. Useful sparging gases include argon, helium, hydrogen, nitrogen, carbon monoxide, carbon dioxide, steam and hydrocarbons. Argon and nitrogen are the preferred dilution and sparging gas. Argon, nitrogen and carbon dioxide are the preferred protective fluids.

DETAILED DESCRIPTION

The present invention is a process which enables one to decarburize rapidly a steel melt while still refining the steel melt efficiently and also producing high quality steel. The process combines an efficient, high quality bottom blowing procedure, such as the AOD process, with a top blowing procedure in such a way that the benefits of the process are retained while avoiding increased risk of slopping, inaccuracy and inefficiency which have heretofore characterized rapid decarburization.

In order to appreciate more fully the benefits of the process of this invention, it is helpful to understand the disadvantages of rapid decarburization.

Slopping is a phenomenon wherein the bath overflows, or otherwise is not contained by, the steelmaking vessel. Slopping can occur in either a top blown or a bottom blown process. However, the mechanism which causes slopping is different in these two situations. In a top blown process, oxygen first reacts with the slag phase before penetration to the melt surface. Consequently, substantial quantities of iron are oxidized. This is because oxygen is injected onto the surface of the bath and thus reacts with carbon-depleted iron forming principally iron oxide. Slopping typically occurs about halfway through the oxygen blow when carbon monoxide evolution is highest and the slag is over oxidized. At this stage the slag-metal emulsion expands filling the vessel freeboard and may overflow. In a bottom blown process, oxygen first reacts with metal, forming principally iron oxide. As the bubble ascends through the bath, the iron oxide is gradually reduced by the carbon in the bath before it reaches the slag phase. Consequently, slag iron oxide levels are low and it is difficult to flux bulk lime additions until quite late in the oxygen blow. If an early fluid slag is not obtained, there is a greatly increased amount of metal splashing and spitting. Furthermore, the lack of an early fluid slag impedes important slag/metal reactions such as dephosphorization. In order to obtain an early fluid slag in a bottom blow process it is necessary to inject powdered lime with the oxygen. However, such a procedure is coomplex and costly. Slopping is more likely to occur the more rapid is the decarburization rate because of the higher rate of oxygen injection which leads to more vigorous oxidation reactions.

The addition of powdered lime to the melt from the top coupled with the diluent effects of inert gas such as nitrogen and argon introduced as protective fluids with the submerged oxygen avoids the increased slopping risk even though the decarburization is rapid. The diluent gases reduce or minimize iron oxide formation thus preventing the formation of an emulsion which overflows the vessel. The lime serves to produce an early fluid slag thus diminishing the risk of metal splashing and spitting due to the bottom blown oxygen. A further advantage is gained when the refining process is the AOD process because the diluent effect of the diluent gas results in low slag levels of manganese oxide. As is known, the presence of high levels of manganese oxide is indicative of a tendency to slop.

Bottom blown processes, and especially the AOD process, are known to have excellent end point carbon control. However, top blown processes are not as accurate. A portion of the top blown oxygen reacts with carbon monoxide coming off the bath to form carbon dioxide. There is an uncertainty as to the exact split of top blown oxygen into that which reacts with carbon monoxide and that which reacts with carbon in the bath, thus leading to an uncertainty as to the actual carbon content of the bath. In order to overcome this problem, the process of this invention terminates the top oxygen blow when the carbon content of the melt is at least 0.1 weight percent and preferably at least 0.2 weight percent greater than the aim carbon content, but not more than 0.5 weight percent and preferably not more than 0.4 weight percent greater than the aim carbon content. Those skilled in the art of steelmaking can estimate accurately, based on their knowledge of the initial melt carbon content and the oxygen injection rate, when to halt the simultaneous injection of top and bottom oxygen, so that the melt is within the above specified carbon range. From this point the melt is brought to its aim carbon content solely by bottom blown decarburization at an oxygen to inert ratio which may be constant or may vary and is in the range of from 3:1 to 1:9.

A convenient and preferred procedure is to determine the carbon content of the melt after the top blown oxygen has been discontinued. This determination is preferably done by means of a sublance. This determination is then used to attain accurately the aim carbon content.

By the use of the process of this invention one can employ the beneficial rapid decarburization characteristic of top blown processes while simultaneously avoiding disadvantages of top blowing and also achieving benefits of bottom blowing. In order to attain this advantageous combination of benefits, the top blown oxygen should be injected at a rate which is from 0.5 to 3 times the injection rate for the bottom blown oxygen, preferably from 1 to 2 times the bottom blown oxygen injection rate. In order to achieve rapid decarburization the top blown oxygen should be injected at a rate of from 1000 to 5000 normal cubic feet per hour (ncfh) per ton of melt, preferably from 2000 to 3000 ncfh per ton, and the bottom blown oxygen should be injected at a rate of from 1000 to 3000, preferably from 1500 to 2500 ncfh per ton. During the time when oxygen is injected into the melt from both above and below the melt surface, the ratio of bottom blown oxygen to inert gas should be in the range of from 2:1 to 5:1.

The amount of powdered lime injected into the melt from above the melt surface in order to achieve non-detrimental rapid decarburization should be from about 2 to 5 times the amount of silicon present in the melt when it is charged to the refining vessel and preferably is from about 3.2 to 4.2 times the amount of silicon present. The silicon content of hot metal may be from 0.15 to 2.5 percent, typically is from 0.3 to 1.0 percent and commonly is from 0.4 to 0.7 percent.

It may be desirable to provide lime in non-powdered, i.e., lump or bulk, form to the bath in addition to the powdered lime to assist in the production of high quality steel. When such non-powdered lime is added to the bath, it should be in an amount of from 3 to 5 times, preferably 4 to 4.3 times the amount of silicon added to the bath as a reducing agent and from 1 to 3.5 times, preferably from 1.5 to 2.5 times the amount of aluminum added to the bath. Such non-powdered lime addition may be made prior to or after the decarburization step depending on the desired quality level. It is preferred to add this non-powdered lime prior to the final decarburization step in which exclusively submerged oxygen and diluent gas is injected.

The decarburization process of this invention is compatible with steps which can be taken to finish a heat to produce high quality steel. For example, the early addition of powdered lime which leads to early fluxing of the lime is advantageous when one is attempting to produce steel having low hydrogen content. Injection of oxygen and inert at a rate and quantity to generate sufficient off-gases to keep ambient air from contacting the melt also aids in producing steel having a low hydrogen content. Low carbon grades of steel can be produced by using a dilute ratio of bottom blowing oxygen to inert gas toward the end of the final bottom oxygen injection. This is advantageous because iron and manganese oxidation is minimized and also because the off-gas rate does not decrease dramatically thus avoiding unwanted pick-up of hydrogen and nitrogen from the atmosphere. Quality advantages are achieved in part because the heat is killed in the steelmaking vessel thereby enabling desulfurization. The final submerged oxygen injection to specification carbon content coupled with a pure argon stir during reduction enable attainment of low hydrogen contents. Ambient air may be kept from contacting the melt by injection inert gas into the melt, during either a reduction or a finishing step at a rate to generate sufficient off-gases. Addition of deoxidizers, such as ferrosilicon, along with lime if required, to the bath after decarburization ensure the basic reduced conditions necessary to achieve extremely low sulfur content.

A particularly preferred way to achieve good desulfurization of the steel melt is to add reducing agent to the bath after the melt has been decarburized to the aim carbon contant and to stir the reducing agent with inert gas to effect mixing of the slag and the melt. Examples of reducing agents include silicon, silicon ferroalloys, aluminum and the like. The reducing agent may be added in any effective amount and generally is added in an amount of up to 5 pounds per ton of melt, preferably up to 3 pounds per ton of melt.

The inert gas is injected into the melt from below the melt surface and at a rate to generate sufficient off-gas substantially to prevent ambient air from contacting the melt. Preferably the inert gas is argon. The inert gas may be injected while the reducing agent is being added to the bath in addition to being injected after the addition. Preferably the inert gas injection is carried out at a rate of from about 600 to 1400 cubic feet per hour per ton of melt and for from about 3 to 5 minutes.

Silicon, aluminum and the like may also be added to the melt during the reduction and/or a finishing step in order to achieve the steel specification. It is advantageous to inject inert gas into the melt during such a finishing step in order to stir in the additions and to generate sufficient off gas to keep unwanted ambient air from contacting the melt, thus keeping hydrogen and nitrogen contamination of the melt low during the finishing step.

A portion of the lime necessary to achieve the non-detrimental rapid decarburization of the process of this invention may be added to the bath in bulk prior to the start of decarburization rather than a powdered lime. This portion added in bulk may be up to about 33 percent of the required amount of powdered lime. The remainder of the required lime is introduced to the bath as powdered lime injected along with the top blown oxygen.

The process of this invention is also compatible with processes for dephosphorizing a melt. In those instances where the melt has a high phosphorus content or where a low phosphorus content is important, the slag may conveniently be removed from the bath after the discontinuance of the top oxygen injection. As is known, this slag contains most of the phosphorus. Lime is then added to make a new slag and the melt is decarburized to its aim carbon content by the bottom injection of oxygen and inert gas.

The following example serves to further illustrate the process of this invention and is not intended to limit the invention.

EXAMPLE I

Fifty tons of hot metal having a carbon content of 4.0 weight percent and a silicon content of 0.6 weight percent is charged at 2550° F. to an AOD vessel. It is desired to decarburize the hot metal to an aim carbon content of 0.08 weight percent carbon. Six hundred pounds of lime are added and then oxygen at the rate of 75,000 ncfh and argon at the rate of 25,000 ncfh are blown into the melt through submerged tuyeres. Simultaneously, oxygen at the rate of 150,000 ncfh is blown onto the surface of the bath through a straight bore top lance along with 2,500 pounds of powdered lime. Nine tons of scrap are added to the hot metal. After 24 minutes of blowing, the oxygen injection is discontinued and a carbon sample reveals that the melt has a carbon content of 0.32 weight percent. The bottom injection is restarted and continues for about 3 minutes after which the carbon content has been reduced to the aim carbon content and the melt temperature is 3050° F. The vessel is turned up and 300 pounds of 75 percent ferrosilicon are added and stirred in with argon at a rate of 40,000 ncfh for 5 minutes. The vessel is turned down, and following a chemical analysis, trim alloy additions, if needed, are made and stirred in with argon at a rate of 40,000 ncfh for two minutes. The heat is tapped at 2980° F. containing less than 50 ppm sulfur, 2 ppm hydrogen and 50 ppm nitrogen.

I claim:

1. A process for the production of steel wherein a steel melt undergoes rapid decarburization to an aim carbon content comprising:

(A) providing a molten metal bath having a carbon content of at least 1.0 weight percent;

(B) injecting oxygen and powdered lime into said bath from above the surface thereof while simultaneously injecting oxygen and inert gas into the melt from below the melt surface, the amount of top injected oxygen being from 0.5 to 3 times the amount of bottom injected oxygen, to decarburize the melt until the melt has a carbon content of at least 0.1 weight percent, but not more than 0.5 weight percent, greater than the aim carbon content;

(C) thereafter discontinuing the top injection of oxygen and powdered lime; and (D) injecting oxygen and inert gas into the melt exclusively from below the melt surface to decarburize the melt until the aim carbon content is attained.

2. The process of claim 1 wherein the ratio of top to bottom injected oxygen during step (B) is from 1 to 2.

3. The process of claim 1 wherein step (B) is terminated when the carbon content of the melt is from 0.2 to 0.4 weight percent greater than the aim carbon content.

4. The process of claim 1 wherein after step (B) the melt is sampled to determine its carbon content and this determination is used to determine the duration of step (D).

5. The process of claim 1 wherein the steel melt is comprised of hot metal.

6. The process of claim 1 wherein the steel melt is comprised of hot metal and steel scrap.

7. The process of claim 1 wherein lime, in addition to that provided to the melt in step (B), is provided to the melt prior to step (B).

8. The process of claim 1 wherein the ratio of bottom blown oxygen to inert gas in step (D) is from 3:1 to 1:9.

9. The process of claim 1 wherein after step (B), the slag is removed from the bath and additional slag-forming lime is added to the melt prior to the start of step (D).

10. The process of claim 1 wherein during steps (B) and (D) the oxygen and inert gas are injected at a rate and quantity to generate sufficient off-gases to keep ambient air from contacting the melt.

11. The process of claim 1 followed by at least one reduction step wherein inert gas is injected into the melt from below the melt surface in an amount and at a rate to generate sufficient off-gas to keep ambient air from contacting the melt.

12. The process of claim 1 followed by at least one finishing step wherein inert gas is injected into the melt from below the melt surface in an amount and at a rate to generate sufficient off-gas to keep ambient air from contacting the melt.

13. The process of claim 1 wherein said process is the AOD process.

14. The process of claim 1 wherein the ratio of bottom blown oxygen to inert gas in step (B) is from 2:1 to 5:1.

15. The process of claim 1 wherein the amount of powdered lime injected in step (B) is from about 2 to 5 times the amount of silicon in the steel melt.

16. The process of claim 1 wherein the inert gas is argon.

17. A process for the production of steel wherein a steel melt undergoes rapid decarburization to an aim carbon content and attains good desulfurization, deoxidation and degassing comprising:

(A) providing a molten metal bath having a carbon content of at least 1.0 weight percent;

(B) injecting oxygen and powdered lime into said bath from above the surface thereof while simultaneously injecting oxygen and inert gas into the melt from below the melt surface, the amount of top injected oxygen being from 0.5 to 3 times the amount of bottom injected oxygen, to decarburize the melt until the melt has a carbon content of at least 0.1 weight percent, but not more than 0.5 weight percent, greater than the aim carbon content;

(C) thereafter discontinuing the top injection of oxygen and powdered lime;

(D) injecting oxygen and inert gas into the melt exclusively from below the melt surface to decarburize the melt until the aim carbon content is attained;

(E) adding at least one reducing agent to the bath; and (F) injecting inert gas into the melt from below the melt surface in an amount and at a rate to mix the melt and the slag, thereby transferring sulfur from the melt to the slag, while generating sufficient off-gas to substantially prevent ambient air from contacting the melt.

18. The process of claim 17 wherein said reducing agent is ferrosilicon.

19. The process of claim 17 wherein said reducing agent is aluminum.

20. The process of claim 17 wherein said reducing agent comprises both ferrosilicon and aluminum.

21. The pocess of claim 17 wherein inert gas injection into the melt from below the melt surface additionally occurs during step (E).

22. The process of claim 17 wherein the inert gas of step (F) is argon.

23. The process of claim 17 wherein the inert gas injection of step (F) takes place at a rate of from about 600 to 1400 cubic feet per hour per ton of melt.

24. The process of claim 17 wherein the inert gas injection of step (F) is carried out for from about 3 to 5 minutes.

25. The process of claim 17 where in step (E) said reducing agent is added to the bath in an amount of up to about 5 pounds per ton of melt.

26. The process of claim 17 comprising an additional lime addition to the bath in non-powdered form in an amount of from 3 to 5 times the amount of silicon added as a reducing agent and from 1 to 3.5 times the amount of aluminum in the melt.

27. The process of claim 26 wherein said additional lime is added prior to step (D).

* * * * *